United States Patent [19]

Nakamura

[11] Patent Number: 4,597,685

[45] Date of Patent: Jul. 1, 1986

[54] CERAMIC PEN POINT AND PEN PROVIDED THEREWITH

[75] Inventor: Noboru Nakamura, Kagoshima, Japan

[73] Assignee: Kyocera Corporation, Japan

[21] Appl. No.: 374,981

[22] Filed: May 5, 1982

Related U.S. Application Data

[63] Continuation of Ser. No. 249,128, Mar. 30, 1981, abandoned.

[51] Int. Cl.[4] ..... B43K 1/00; B43K 8/00

[52] U.S. Cl. ..... 401/199; 401/196; 401/265

[58] Field of Search ..... 401/196, 198, 199, 292, 401/265

[56] References Cited

U.S. PATENT DOCUMENTS

| | | | |
|---|---|---|---|
| 2,396,058 | 3/1946 | Rath | 401/198 |
| 2,666,416 | 1/1954 | Rickmeyer | 401/198 X |
| 3,666,411 | 5/1972 | Collier | 423/625 |
| 3,843,270 | 10/1974 | Kirill et al. | 401/292 |
| 3,942,903 | 3/1976 | Dickey et al. | 401/198 |
| 4,336,767 | 6/1982 | Wada | 401/198 X |

FOREIGN PATENT DOCUMENTS

| | | | |
|---|---|---|---|
| 731843 | 4/1966 | Canada | 401/292 |
| 2547000 | 4/1976 | Fed. Rep. of Germany | 401/199 |
| 2535906 | 2/1977 | Fed. Rep. of Germany | 401/196 |
| 2376759 | 9/1978 | France | 401/196 |
| 1112684 | 5/1968 | United Kingdom | 401/198 |

*Primary Examiner*—Steven A. Bratlie

*Attorney, Agent, or Firm*—Spensley Horn Jubas & Lubitz

[57] ABSTRACT

This invention relates to a uniquely configured pen. The pen has an ink storage portion for holding the ink, a pipe-like pen point made of alumina and an ink guide core extending between the pen point and the ink storage portion.

8 Claims, 3 Drawing Figures

CERAMIC PEN POINT AND PEN PROVIDED THEREWITH

This is a continuation of application Ser. No. 06/249,128, filed Mar. 30, 1981 now abandoned.

BACKGROUND OF THE INVENTION (1) Field of the Invention

The present invention relates to a pen point formed of a ceramic material and a pen utilizing this ceramic pen point.

(2) Description of the Prior Art

Among conventional writing tools, sign pens are now used most frequently. In sign pens, an ink is included in the pen in a state where it is absorbed in cotton of felt. During use, this ink is guided to a pen point formed of felt or plastics and writing is accomplished by moving the point on paper. Such sign pens are excellent in their ink spreading ability and the sliding characteristic during use.

However, since the pen point is formed of a felt or plastic material which is readily worn away, the writing feel is readily changed while the pen is used, and the thickness of written lines is increased after the pen has been used for a length of time. As means for maintaining certain line thickness and writing feel, a Rotring drawing tool has been used having a pen point formed of stainless steel and a writing tool having a pen point of ruby or sapphire. These writing tools have the shortcoming that they should be used substantially at a right angle to the surface of paper. In case of a stainless steel pen point, the tip of the pen point is worn away when the pen is used for a long time, resulting in changes in the line thickness. Moreover, since there is often lack of compatibility of the tip of the stainless steel pen point with the ink, the ink spreading rate is readily changed and writtin lines (letters) are often blurred. Furthermore, although straight lines can be written smoothly with a writing tool having a pen point of stainless steel, curved lines or letters having thick and thin portions in combination cannot suitably be written with such writing tool, and poor sliding characteristics on paper are not particularly desirable.

SUMMARY OF THE INVENTION

It is a primary object of the present invention to provide a pen in which the foregoing defects involved in the conventional pens and writing tools are eliminated.

Another object of the present invention is to provide a pen point which slides well on the surface of paper upon writing without occurrence of blurring or the like and is excellent in writing properties and abrasion resistance.

In accordance with one fundamental aspect of the present invention, there is provided a ceramic pen point formed of a ceramic body being composed mainly of alumina and having an average crystal grain size of 1 to 80$\mu$.

In accordance with another fundamental aspect of the present invention, there is provided a pen comprising an ink storage portion for containing an ink therein, and pen point attached to the top end of said pen through a holder. The pen point has a small-diameter hole leading to the tip thereof, and an ink guiding core is inserted into the small-diameter hole of the pen point. The core has the rear end extended to the ink store portion of the pen. In the preferred embodiment, the pen point is formed of a ceramic body being composed mainly of alumina and having an average crystal grain size of 1 to 80$\mu$.

DETAILED DESCRIPTION OF THE PREFERRED EMBODIMENTS

Figure 1:
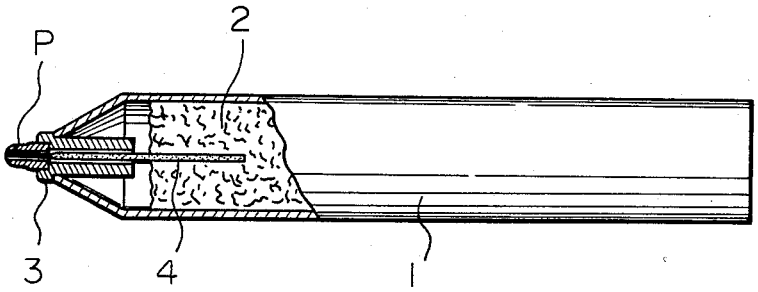
FIG. 1 is a partially cut-away diagram illustrating a writing tool provided with a ceramic pen point according to the present invention.

Referring to FIG. 1 illustrating one embodiment of the pen according to the present invention, an ink absorber 2 formed of felt or cotton is packed in a pen 1. Ink absorber 2 is impregnated with an ink of a predetermined color. A pen point P is attached to the top end of the pen 1 through a holder 3. A small-hole H is formed through the pen point P and an ink guiding core 4 is inserted into this small-diameter hole H so that the ink contained in the ink absorber 2 is guided to the pen point P.

Figure 2:
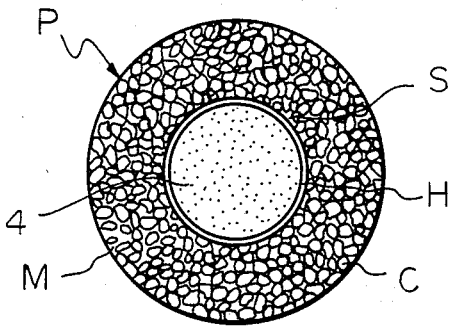
FIG. 2 is an enlarged view showing the tip portion of the pen point shown in FIG. 1.
Figure 3:
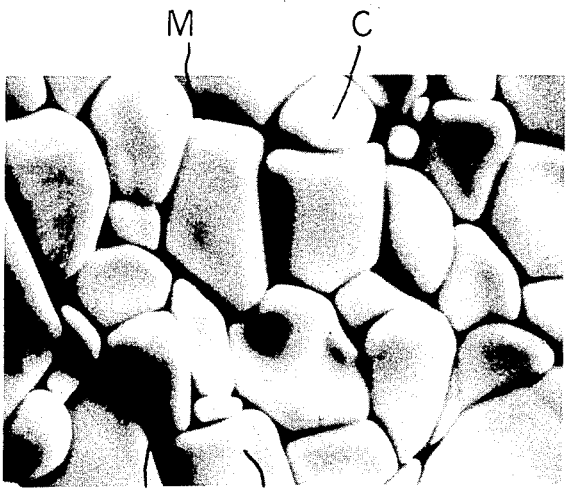
FIG. 3 is a microscopic picture (2000 magnifications) showing the surface portion of a ceramic body constituting the pen point of the present invention.

In the present invention, the pen point P is formed of a ceramic body obtained by molding and sintering alumina ($Al_2O_3$). As is seen from FIG. 2 showing the tip portion of the pen point P and FIG. 3 which is a microscopic picture of the surface of this ceramic body, an indefinite number of roundish alumina fine crystals C are aggregated on the surface of the ceramic body, and fine grooves M run among these fine crystals C.

In the pen point P of the present invention, which is formed of the above-mentioned ceramic body of alumina, the ink stored in the ink absorber 2 is guided through the ink guiding core 4 and is allowed to come into contact with the wall face of the small-diameter hole H formed through the pen point P. Alternatively, the ink flows through minute spaces S between the guiding core 4 and the wall face of the small-diameter hole H, whereby an appropriate amount of the ink is supplied to the tip portion of the pen point P. When the ink is guided to the pen point P formed of such ceramic body, the ink is allowed to travel along the grooves M formed among an indefinite number of alumina crystals C. Accordingly, the pen point P is always kept wet for writing. On writing, the ink is gradually supplied to the pen point P from the ink absorber 2 through the ink guiding core 4. In the present invention, the ink guiding core 4 is inserted into the small-diameter hole H in such a manner that the top end of the guiding core 4 is on the same level as that of the tip face of the pen point P or is slightly projected from the tip face of the pen point P. Since the pen point P is kept wet in this state, a line having a desirable thickness can be smoothly written with the pen point P. Further, the thickness of the line can be controlled according to the writing angle of the pen point P.

Since the pen point of the present invention is always kept wet with the ink and an appropriate amount of the ink is supplied from the ink absorber through the ink guiding core on writing, written lines are not blurred even in the initial portions of the written lines. Ink accidentally falling from the pen point is also prevented.

Since the surface of the pen point is formed of roundish fine alumina crystals, the sliding action on the surface of paper is also very good. By virtue of good abrasion resistance and corrosion resistance inherent in the ceramic body, the initial writing feel is not lost even after the pen has been used for a long time. Finally, changes of thickness in written lines can remarkably be diminished.

In the following example, the relation between the average crystal grain size of the ceramic body used for the pen point P of the present invention and the writing properties was examined.

EXAMPLE

A pen having a structure shown in FIG. 1 was prepared by using an alumina ceramic body having an average crystal grain size shown in the following Table for the pen point P. The writing properties of the pen were tested to obtain the results shown in the following Table. The radius R of curvature in the tip portion of the pen point P used was 0.7 mm.

TABLE

| Average Crystal Grain Size of Alumina Ceramic | Writing Properties |
|---|---|
| 120 | no sliding on paper surface |
| 100 | slight scratch on paper surface and lines blurred |
| 80 | slight scratch with no blurring |
| 60 | good sliding with no blurring |
| 40 or less | good sliding with no blurring |

From the above results, one can see that it is preferred for the average crystal grain size of the ceramic body to be not larger than 80μ. It has also been found that the lower limit of the average crystal grain size of the ceramic body is preferably about 1μ, though the lower limit varies to some extent depending on the sintering temperature or the like. From the experiments made, it has been found that better results are obtained when the average crystal grain size is 5 to 60μ, especially 10 to 20μ.

What I claim is:

1. A ceramic pen point formed of a dense ceramic body having a small-diameter hole leading to the tip thereof, said ceramic body being composed of an aggregate of roundish fine crystals of alumina having an average crystal grain size of 1 to 80 microns.

2. A ceramic pen point as set forth in claim 1, wherein the average crystal gain size is 5 to 60 microns.

3. A ceramic pen point as set forth in claim 2, wherein the average crystal grain size is 10 to 20 microns.

4. A pen comprising an ink store portion for containing an ink therein, a pipe-like pen point attached to the top end of said pen through a holder, said pen point having a small-diameter hole leading to the tip thereof, and an ink guiding core inserted into the small-diameter hole of the pen point, said core having the rear end extended to the ink store portion and wherein said pen point is formed of a dense ceramic body being composed of an aggregate of roundish fine crystals of alumina having an average crystal grain size of 1 to 80 microns.

5. A pen as set forth in claim 4, wherein the pen point has a roundish tip and the ink guiding core is inserted into the small-diameter hole in such a manner that the tip end of the ink guiding core is on the same level as that of the tip face of the pen point.

6. A pen as set forth in claim 1, wherein an ink absorber impregnated with an ink is contained in said pen.

7. A pen as set forth in claim 4, wherein the ink guiding core is inserted into the small-diameter hole in such a manner that the top end of the ink guiding core is slightly projected from the face of the pen point.

8. A pen comprising:

a reservoir for storing ink;

a pen point composed primarily of alumina crystals having an average crystal grain size of 1 to 80 microns; and means for transferring the ink from the reservoir to the pen point.

* * * * *